United States Patent [19]

Ponn

[11] Patent Number: 4,857,010

[45] Date of Patent: Aug. 15, 1989

[54] RIBBON CABLE HARNESS AND METHOD OF MAKING SAME

[75] Inventor: Timothy R. Ponn, Aurora, Ill.

[73] Assignee: Molex Incorporated, Lisle, Ill.

[21] Appl. No.: 588,622

[22] Filed: Mar. 12, 1984

Related U.S. Application Data

[63] Continuation-in-part of Ser. No. 487,377, Apr. 21, 1983, abandoned.

[51] Int. Cl.[4] ..... H01R 4/24

[52] U.S. Cl. ..... 439/417

[58] Field of Search ..... 339/97 R, 97 P, 98, 339/99 R,

[56] References Cited

U.S. PATENT DOCUMENTS 2,666,093 1/1954 Wildberg ..... 174/117 R
3,860,318 1/1975 Reavis, Jr. et al. ..... 339/99 R
4,295,704 10/1981 Narozny ..... 339/99 R
4,367,004 1/1983 Fujiura ..... 339/99 R

FOREIGN PATENT DOCUMENTS 12100 6/1980 European Pat. Off. ..... 174/117 F
20578 2/1978 Japan ..... 174/117 F

*Primary Examiner*—Joseph H. McGlynn
*Attorney, Agent, or Firm*—Louis A. Hecht

[57] ABSTRACT

An electrical ribbon cable harness which includes a flat electrical ribbon cable terminated to an insulation displacement type electrical connector. The cable is manufactured such that upon displacement of the cable conductors, the webs between said conductors are separated along a groove and positioned out of the way thereby obviating a notching step in the production of said electrical ribbon cable harness.

1 Claim, 1 Drawing Sheet

RIBBON CABLE HARNESS AND METHOD OF MAKING SAME

CROSS-REFERENCE TO RELATED APPLICATIONS

This is a continuation-in-part of copending application Ser. No. 487,377 filed Apr. 21, 1983, now abandoned.

BACKGROUND OF THE INVENTION

1. Field of the Invention

This invention relates to an electrical harness which includes a flat electrical ribbon cable terminated to an electrical connector assembly by displacement of the insulation surrounding the cable conductors and the method of producing said harness.

2. Description of the Prior Art

Electrical ribbon cable has gained wide acceptance in a variety of applications involving the interconnection wiring of electrical and electronic assemblies. It is particularly suitable for low voltage applications such as in the interconnection of telecommunications or computer subassemblies where a plurality of discrete electrical signals are required to be transmitted from one subassembly to another. Typically in these applications, the interconnection ribbon cable is terminated at each end with electrical connectors having the capability of being mounted on printed circuit boards by connection to a plurality of spaced wire pins which have been wave-soldered to the board circuitry, for example.

In order to ensure that ribbon cables of various origins are compatible with generally accepted printed circuit (PC) board design configurations, industry conventions have developed such that ribbon cable is manufactured with standard center spacing of the cable conductors. Generally, the conductor center spacings which have been adopted are those spacings which have been found preferable for standardized pin separation in the design of PC board circuitry layout. These spacings are typically on the order of several conductor-diameters in magnitude. Accordingly, it is common practice to manufacture ribbon cable by an extrusion process which coats the conductors with a relatively uniform layer of insulation and joins adjacent pairs of conductors in spaced-apart relationship with a web of extruded insulation. The webs need only have a thickness sufficient to maintain the individual conductors in uniform separation and assure the integrity of the cable as a unitary structure during handling and use.

For economy of manufacture, it has been found desirable to extrude ribbon cable with a predetermined large number of conductors, and then separate the conductors by tearing to obtain a cable having a lesser width where fewer interconnection circuits are needed. By such a method, manufacturing efficiency is enhanced, inasmuch as only one extrusion die and related machinery are necessary to manufacture ribbon cable of various widths. To facilitate the uniform tearing of the master cable into cables having lesser width, it is common practice to extrude the master cable with lengthwise grooves formed in the webs residing between the conductors. In prior art cables, these grooves have been positioned equi-distant between adjacent pairs of conductors.

One method of terminating interconnection wiring that has gained wide acceptance in the above-mentioned applications because of its efficiency in assembly is mass termination by insulation displacement. In the insulation displacement process, the conductors are not stripped of their covering insulation prior to termination, whether they are discrete insulated wires or in ribbon cable form. Instead, the insulation is severed and displaced by the respective terminal to which the conductor is electrically connected. Connectors having the capability of insulation displacement termination are disclosed, for example, in U.S. Pat. No. 4,217,022 to Carre and typically comprise a row of stamped, conductor engaging ends with insulation displacement slots formed therein for receiving and making electrical contact with the respective conductors of the interconnection wiring or cable.

Where ribbon cable is used instead of discrete insulated wire, it is common practice to notch the cable to remove the insulation webs for a distance from the cable end or along an interior portion of the cable at the locations where connectors are to be installed. Notching of the ribbon cable is desirable for the reason that it permits the cable to be terminated as if it were composed of a plurality of discrete wires. More specifically, by removal of the webs in the region of the connector termination, less force is required to press the cable conductors into their respective terminals and a more reliable connection between the cable conductors and terminals can be assured. Additionally, if the webs are not notched, there is a tendency for overpacking of the terminal interface area with excess insulation causing withdrawal forces to be imposed on the conductors as a result of the latent resiliency of the insulation. This condition can, with time, result in inadequate electrical conductivity at the terminal-to-conductor interface of an operative connector. The step of notching, however, involves the use of specialized equipment and added investment of time to adequately prepare the cable for termination. Additionally, where the cable user is unequipped to notch the cable but requires multiple connector terminations within a single cable span, the cable must be specially notched by the cable manufacturer resulting in increased cost to the cable user.

SUMMARY OF THE INVENTION

It is, therefore, a principal object of the present invention to provide a new and improved electrical harness including ribbon cable terminated to an electrical connector with greater manufacturing efficiency. More particularly, it is an object of the present invention to provide an electrical harness of the type described which requires no notching of the webs from the cable but which retains the capability of being terminated with a reliable interface between each of the cable conductors and corresponding terminals of the connector. It is a further object of the present invention to provide an electrical harness in which the webs of the cable are not notched but which may be easily terminated with a connector at any desired position along the cable length.

The foregoing objects are realized in the one embodiment of the electrical harness which includes an electrical having a housing with a plurality of terminal receiving cavities formed therein, a plurality of terminals, one mounted in each of said cavities, each terminal having a conductor engaging end with an insulation displacement slot formed therein, each conductor engaging end extending out of the housing and being separated by walls defining extensions of the cavities. Electrical ribbon cable is terminated to said connector and has a plurality of parallel, spaced-apart conductors, each of said conductors being embedded in a continuous, generally planar layer of insulation with a plurality of webs integrally formed between said conductors, each web having at least one groove extending parallel to said conductors, said cable having a connecting end wherein said conductors are separated from one another and electrically connected to each of the terminal insulation displacement slots. The improvement in said electrical harness comprises:

at least a portion of each web being separated at the connecting end from the adjacent conductor along the groove.

Another principal object of the present invention is to provide a new and improved method of making the electrical harness described above. Said method comprises the steps of:

aligning the conductors over their respective insulation displacement slots with said webs generally overlying said walls; and forcing the conductors downwardly laterally of their longitudinal axes so that the conductors are received in their respective slots and said webs are forced against the walls to tear each web along its groove a short distance adjacent the connector so that said conductors retain a substantially uniform coating of insulation around the portion of the circumference received in the slots.

BRIEF DESCRIPTION OF THE DRAWINGS

The structure and advantages of ribbon cable manufactured in accordance with the invention will be better understood from consideration of the detailed description of the two illustrative embodiments thereof which follow, when taken in conjunction with the accompanying drawings in which.

DESCRIPTION OF THE PREFERRED EMBODIMENT

Figure 1:
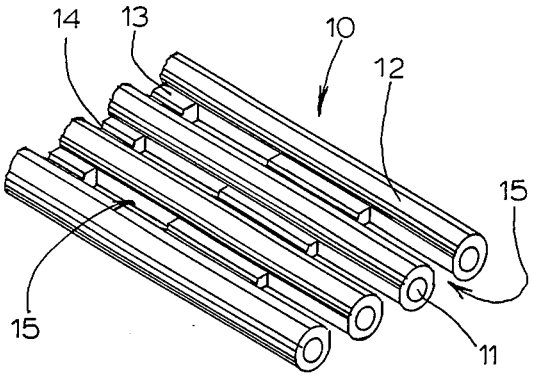
FIG.1 PRIOR ART
FIG. 1 is a perspective view of a typical prior art cable having notches between the cable conductors.

Referring first to FIG. 1, a prior art, round-conductor ribbon cable, designated generally by the reference numeral 10, is shown. The ribbon cable 10 consists of a plurality of electrical conductors 11 enveloped in a coating of insulation 12. The conductors 11 are arranged in parallel side-by-side relationship, uniformly separated from each other by a standard dimension which is maintained by connecting webs of insulation 13. Formed in the webs of insulation 13 are grooves 14 running lengthwise of the conductors 11 and positioned equi-distantly between adjacent pairs of conductors 11. To facilitate termination of the cable 10 to an insulation displacement type connector, the cable 10 is provided with notches 15 formed in the webs of insulation 13 at the locations where connectors are intended to be installed.

Figure 2:
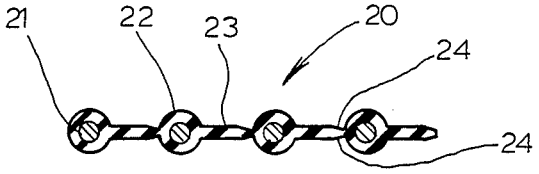
FIG. 2 is an end sectional view of a multi-conductor flat cable used in the harness of the present invention.

Referring now to FIG. 2, there is shown an improved round-conductor ribbon cable 20 manufactured in accordance with the present invention and comprising electrical conductors 21 enveloped in a coating of insulation 22. Ribbon cable 20 may be made by an extrusion process whereby continuous lengths of conductors 21 are conveyed through a die which forms the insulation layer 22 in any desired cross-sectional configuration. Preferably, the conductors 21 are arranged in parallel side-by-side relationship, uniformly separated by webs of insulation 23 which have a thickness no more than that required to maintain the cable 20 as a unitary structure in handling and in use. Formed in the webs of insulation 23 are grooves 24 positioned in close proximity to one of the pair of conductors 21 between which each web 23 is formed. The grooves 24 permit manual or machine separation of the cable 20 into preselected conductor groupings, and additionally, they facilitate termination of the cable 20 without notching, in a manner which will, hereinafter, be described in greater detail.

Figure 3:
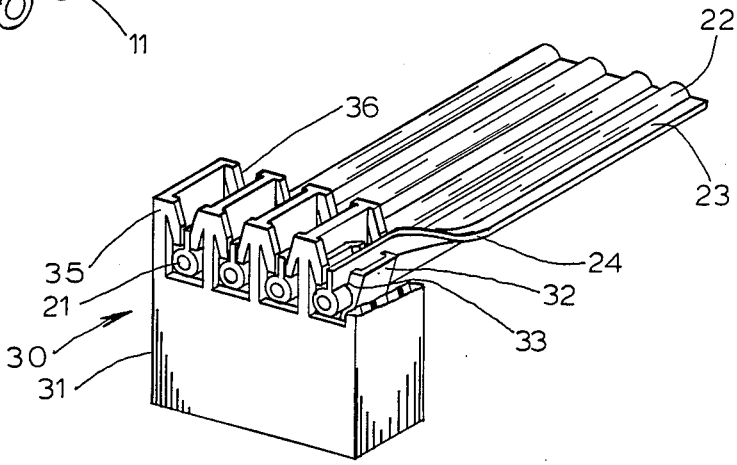
FIG. 3 is a perspective view, partially in section, of the harness of the present invention wherein the ribbon cable of FIG. 2 is terminated to a typical insulation displacement type connector.

Referring now to FIG. 3, a portion of the cable 20 shown in FIG. 2 is disclosed in association with an insulation displacement type connector, designated generally by the reference numeral 30. The connector 30 includes a rigid dielectric housing 31 having a plurality of cavities into which are fitted a plurality of metal insulation displacement type terminals 32. Each terminal 32 has a conductor engaging end formed with an insulation displacement slot 33 adapted to receive an individual conductor 21 therein.

The conductor engaging end and slot 33 extends out of housing 31. The conductor engaging ends are separated from one another by walls which are extensions of the cavities.

Molded integrally with the housing 31 and extending to a position immediately above and on either side of terminals 32 are a plurality of pairs of strain reliefs 35 connected together by the walls. Each strain relief 35 is configured with angled surfaces 36 which serve to guide the individual conductors 21 into position over their respective mating terminals 32 over the slots 33. The strain reliefs 35 also serve to retain the conductors 21, within the slotted terminals 32 after termination. Because of their somewhat pointed configuration, the walls and strain reliefs 35 initiate the severing of the ribbon cable webs 23 along groove 24 upon moving the cable towards the connector 30 in order to effect termination.

Figure 4:
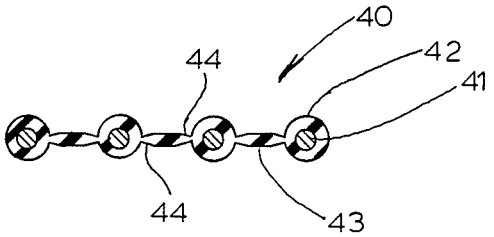
FIG. 4 is an end sectional view of an alternative embodiment of the ribbon cable used in the harness of the present invention wherein the cable insulation has been extruded with two lengthwise grooves.
Figure 5:
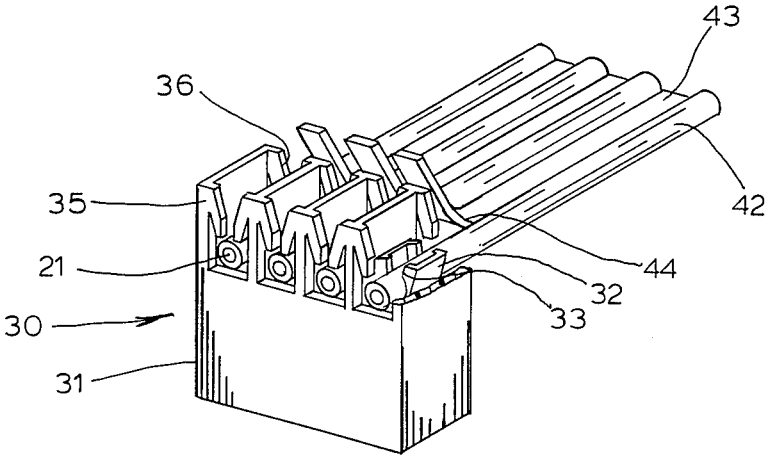
FIG. 5 is a perspective view, partially in section, showing the harness of the present invention terminated to the ribbon cable of FIG. 4.

Turning now to FIG. 4, there is shown an alternative embodiment of the present invention in which a ribbon cable, designated generally by the reference numeral 40, is provided with web grooves 44 immediately adjacent to both sides of the individual conductors 41. As a result of the dual groove construction and, as best shown in FIG. 5, upon termination of the cable 40 to an insulation displacement connector 30, the webs 43 sever completely away from the conductors 41 in a flap-like manner for a suitable distance from the cable end or along an interior portion (not shown) of the cable 40. By this arrangement, the cable conductors 41 become, in effect, the equivalent of discrete insulated wires, and they can be terminated with relatively uniform severing of their insulation covering by the edge portions 33 of the terminals 32.

Upon termination of the ribbon cable 20 of FIG. 2, as best shown in FIG. 3, the cable 20 severs at each of the grooves 24 formed between adjacent pairs of conductors 21 as a result of piercing action imposed on the webs 23 by the walls and pointed strain reliefs 35 of the connector housing 31. As the cable conductors 21 are further forced into the terminals 32 of the connector 30, they rotate about their longitudinal axes due to the pivotal interaction of the webs 23 with the surfaces 33 of the terminals 32 and of the surfaces 36 of the strain reliefs 35. By the rotation of the conductors 21, the webs 23 are caused to trail the conductors 21 into the terminals 32 as final termination is achieved. Accordingly, the webs 23 do not interfere with the displacement of the insulation layer 22 adjacent the conductors 21 by the terminal edge surfaces 33. Additionally, there is no overpacking of the opposed terminal edges 33 with web insulation, thus avoiding the tendency for excess web insulation 23 to withdraw the conductors 21 from seated relationship with the terminals 32 as a result of the latent resiliency of the insulation 22.

Upon termination of the alternative cable 40 of FIG. 4, as best shown in FIG. 5, the cable 40 severs at each of the grooves 44 formed at the juncture of the webs 43 with the conductors 41 as a result of piercing action imposed by the walls and strain reliefs 35. After severance, the webs 43 completely dissociate from between the conductors 41 and will not enter the region of the opposed edges 33 of the connector terminals 32.

The grooves 24 and 44 are so configured and located as to permit severing of the webs 23 and 43, respectively, without exposing the conductors 21 and 41 to the environment or reducing the dielectric properties of the cable 20, 40. Also the grooves are configured and positioned such that the conductors 21 and 41 have a substantially uniform thickness of insulation 22 and 42, respectively, after severance of the webs. In this manner, the cable 20 and 40 may be separated along its entire length to provide a cable of lesser width without reducing the dielectric properties of the cable as a result of excessive thinness of the insulative covering 22, 42 along the edges of the resultant cable.

Because cables 20 and 40 do not require the step of notching in order to effect termination, connectors may be installed at any positions along a cable span without prior preparation of the cable. Accordingly, the cable user is not limited to placement of connectors only at cable sections which have been pre-notched by the cable manufacturer.

I claim:

1. A method of connecting an electrical ribbon cable to an electrical connector, said connector including a housing with a plurality of terminal receiving cavities formed therein, a plurality of terminals, one mounted in each cavity, each terminal having a conductor engaging end with an insulation displacement slot formed therein, each conductor engaging end extending out of the housing and being separated by walls defining extensions of said cavities, said walls having upper free ends with angled surfaces forming funnel-shaped wire-receiving openings communicating with said slots, said cable including a plurality of parallel, spaced-apart conductors, each of said conductors being embedded in a continuous, generally planar layer of insulation with a plurality of webs integrally formed between said conductors, each web having at least one groove extending parallel to said conductors, the method comprising the steps of:

aligning the conductors over their respective insulation displacement slots with said webs generally overlying said free ends of said walls, and forcing the conductors downwardly laterally of their longitudinal axes so that said webs are forced against the free ends of the walls to tear each web along its groove a short distance adjacent the connector so that said conductors retain a substantially uniform coating of insulation around the portion of the circumference received in the slots and to guide said conductors into their respective slots.

* * * * *